US007211956B2

(12) United States Patent
Tukamoto et al.

(10) Patent No.: US 7,211,956 B2
(45) Date of Patent: May 1, 2007

(54) SHORT ARC ULTRA-HIGH PRESSURE MERCURY LAMP WITH ROUNDED END FACES OF COIL TIPS AND PROCESS OF PRODUCING SUCH A LAMP

(75) Inventors: Takuya Tukamoto, Himeji (JP); Yoshihiro Horikawa, Himeji (JP); Yoshikazu Suzuki, Yokohama (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 321 days.

(21) Appl. No.: 10/859,164

(22) Filed: Jun. 3, 2004

(65) Prior Publication Data

US 2004/0245930 A1 Dec. 9, 2004

(30) Foreign Application Priority Data

Jun. 3, 2003 (JP) ..... 2003-157776

(51) Int. Cl.
*H01J 61/04* (2006.01)

(52) U.S. Cl. ..... 313/631; 313/627; 313/628; 313/629; 313/634

(58) Field of Classification Search ..... 313/631, 313/628, 627, 629, 630, 632–643, 491, 590, 313/605–606, 571, 291, 326, 344; 445/26, 445/46, 29

See application file for complete search history.

(56) References Cited

U.S. PATENT DOCUMENTS

| | | | | |
|---|---|---|---|---|
| 4,952,841 | A * | 8/1990 | Coomans et al. | 313/631 |
| 5,109,181 | A | 4/1992 | Fischer et al. | |
| 5,497,049 | A | 3/1996 | Fischer | |
| 6,342,764 | B1 * | 1/2002 | Nishiura et al. | 313/631 |
| 6,545,430 | B2 | 4/2003 | Ono et al. | |

* cited by examiner

*Primary Examiner*—Joseph Williams
*Assistant Examiner*—Hana A. Sanei
(74) *Attorney, Agent, or Firm*—David S. Safran

(57) ABSTRACT

A short-arc ultra-high pressure mercury lamp in which the change in the shape of the electrodes can be suppressed and a stable arc discharge can always be produced is achieved in an arrangement in which, in the silica glass arc tube, there is a pair of opposed electrodes with a distance between them of at most 2 mm and the tube is filled with at least 0.15 mg/mm$^3$ of mercury, a rare gas, and a halogen in the range from $1\times10^{-6}$ μmole/mm$^3$ to $1\times10^{-2}$ μmole/mm$^3$, by at least one of the electrodes having a melt part formed toward the electrode tip by winding the electrode rod with a coil and by melting the part of the coil oriented towards the electrode tip at least in the area of its surface. A part of the coil located away from the electrode tip is unmelted and the base point side area of the coil facing away from the electrode tip is rounded and does not have sharp edges.

9 Claims, 5 Drawing Sheets

SHORT ARC ULTRA-HIGH PRESSURE MERCURY LAMP WITH ROUNDED END FACES OF COIL TIPS AND PROCESS OF PRODUCING SUCH A LAMP

BACKGROUND OF THE INVENTION

1. Field of the Invention

The invention relates to a short arc ultra-high pressure mercury lamp. The invention relates especially to a discharge lamp for a light source which is used for a projector device, such as a liquid crystal display device or a DLP (digital light processor) using a DMD (digital micro mirror device), or the like, with a light source which is an ultra-high pressure mercury lamp in which an arc tube is filled with at least 0.15 mg/mm$^3$ of mercury, and in which the mercury vapor pressure during operation is at least 110 atm. The invention is also directed to a process of producing such a lamp.

2. Description of the Related Art

In a display device of the projection type, there is a demand for illumination of images onto a rectangular screen in a uniform manner and with adequate color rendering. The light source is therefore a metal halide lamp which is filled with mercury and a metal halide. Furthermore, recently smaller and smaller metal halide lamps, and more and more often point light sources are being produced, and metal halide lamps with extremely small distances between the electrodes are being used in practice.

Against this background, instead of metal halide lamps, lamps with an extremely high mercury vapor pressure, for example, with 150 atm, have been recently proposed. Here, the broadening of the arc is suppressed (the arc is compressed) by the increase of the mercury vapor pressure and a great increase of light intensity is the goal.

These ultra-high pressure discharge lamps are disclosed, for example, in Japanese patent disclosure document HEI 2-148561 (U.S. Pat. No. 5,109,181) and Japanese patent disclosure document HEI 6-52830 (U.S. Pat. No. 5,497,049).

For the above described lamp, for example, an ultra-high pressure mercury lamp is used in which there is a pair of opposed electrodes in the silica glass arc tube with a distance of at most 2 mm between them, and in which this arc tube is filled with at least 0.15 mg/mm$^3$ of mercury and a halogen in the range of $1\times10^{-6}$ μmole/mm$^3$ to $1\times10^{-2}$ μmole/mm$^3$. The main purpose of adding the halogen is to prevent devitrification of the arc tube. However, in this way, the so-called halogen cycle also arises.

In the above described ultra-high pressure mercury lamp (hereinafter also called only a "discharge lamp"), the phenomenon occurs that, in the course of operation, the electrodes are deformed, and that the arc discharge assumes a turbulent form. This phenomenon occurs depending on this discharge lamp or does not occur at all. When these changes of shape become greater, the discharge lamp can no longer be used.

SUMMARY OF THE INVENTION

A primary object of the present invention is to devise a short arc ultra-high pressure mercury lamp in which the change in the shape of the electrodes can be suppressed and a stable arc discharge can always be produced.

The above described object is achieved, according to a first aspect of the invention, in a short arc ultra-high pressure mercury lamp in which the silica glass arc tube contains a pair of opposed electrodes which are spaced at a distance of at most 2 mm and the tube is filled with at least 0.15 mg/mm$^3$ mercury, a rare gas and a halogen in the range from $1\times10^{-6}$ μmole/mm$^3$ to $1\times10^{-2}$ μmole/mm$^3$, in that at least one of the electrodes has a melt part with a greater diameter which has been formed by the melting of the tip part of a coil with which the electrode rod is wound, and a coil part which borders behind this melt part with a greater diameter continuously and moreover integrally with it, and that the end on the base point side of this coil is rounded without a pointed area.

The object is furthermore achieved in accordance with the invention in that the end on the base point side of the above described coil is subjected to curved surface treatment.

The object is furthermore achieved as according to the invention in that the above described coil is melted.

The object is moreover achieved in accordance with the invention in that the above described coil has a double turn arrangement in which it is wound from the electrode tip in the direction to the base point around the electrode rod, and in which it is afterwards turned over and is wound from the base point in the direction to the tip and that at least the end which is located on the outside surface is melted integrally with the melt part with a greater diameter.

The object is moreover achieved according to the invention in that the end on the base point side of the above described coil is formed integrally with the electrode rod by melting.

The inventors, as a result of assiduous research, found that the above described change of shape of the electrode is caused by a current concentration on the back end of the coil in a discharge in the transition from a glow discharge immediately after startup of the lamp into an arc discharge, the back end of the coil acting as the start point. It was found that tungsten accumulates due to this cause on the back end of the coil by a chemical reaction within the discharge vessel and grows by operation of a few hundred hours until it reaches the inside of the discharge vessel, and that under certain circumstances cracks form in the discharge vessel.

FIGS. 3(*a*) and 3(*b*) each are enlarged views of the arrangement in the vicinity of the base point of the electrode. FIGS. 3(*a*) and 3(*b*) show the same arrangement. However, FIG. 3(*a*) is provided with reference numbers which describe the arrangement, while FIG. 3(*b*) is provided with reference characters which describe the reaction within the discharge vessel.

When the lamp is installed in a projector device, such as the discharge lamp of the invention, there is also a great demand for reducing the size of the discharge lamp in itself, since a reduction in the size of the projector device is required. On the other hand, it is necessary that, to a certain extent, the electrodes have a thermal capacity because the discharge lamp is operated under high temperature conditions. Here, a certain size (volume) is needed.

Therefore, as is shown in the drawings, the distance L between the coil part 4 of the electrode 1 and the wall of the discharge vessel is extremely small. The distance L, as a numerical value, for example, is less than or equal to 2.0 mm. Specifically there are also lamps with a distance L that is at most 1.5 mm or 1.0 mm. The distance defined here is the shortest distance between the coil part and the wall of the discharge vessel.

The inventors assume that the reason why the distance L shrinks throughout the course of lamp operation is the following:

If the current is concentrated on the back end of the coil 4, locally heated tungsten vaporizes such that it sprays radially from the surface. Since the vaporized tungsten has a lower ionization potential than mercury and the rare gas, it is easily ionized by an arc e. Thereby, the conduction path of the arc e is routed to the inside surface of the discharge vessel which is nearest the back end of the coil 4. As a result, it happens that the arc e with a high temperature comes into contact with the inside of the discharge vessel or collides with it, as is shown in the drawings. In this way, local hollowing of the inside of the discharge vessel and vaporization of the silica glass ($SiO_2$) as the material of the discharge vessel are caused. The vaporized $SiO_2$ is decomposed into Si and O by the discharge plasma and causes vaporization of tungsten as the oxide from the electrode tip. This oxide of tungsten is transported to the back end of the coil and shortens the distance L even more by accumulation as W (metallic tungsten) by an elimination reaction of the tungsten oxide. If each time the lamp is started up this phenomenon occurs with a certain probability, greater growth is caused. It can be imagined that by repeating the cycle of these reactions, the growth and the accumulation of tungsten would occur until it came into contact with the inside of the discharge vessel.

The above described phenomenon occurs in a discharge lamp in which the coil and the inside of the discharge vessel have approached one another very closely. However, the inventors found that it is not necessary to proceed as far as to such a disadvantage if it is simply possible for the discharge arc which forms from the back end of the coil to suppress the current concentration simultaneously with the start of the discharge.

The invention is described in further detail below with reference to the accompanying drawings.

DETAILED DESCRIPTION OF THE INVENTION

Figure 1:
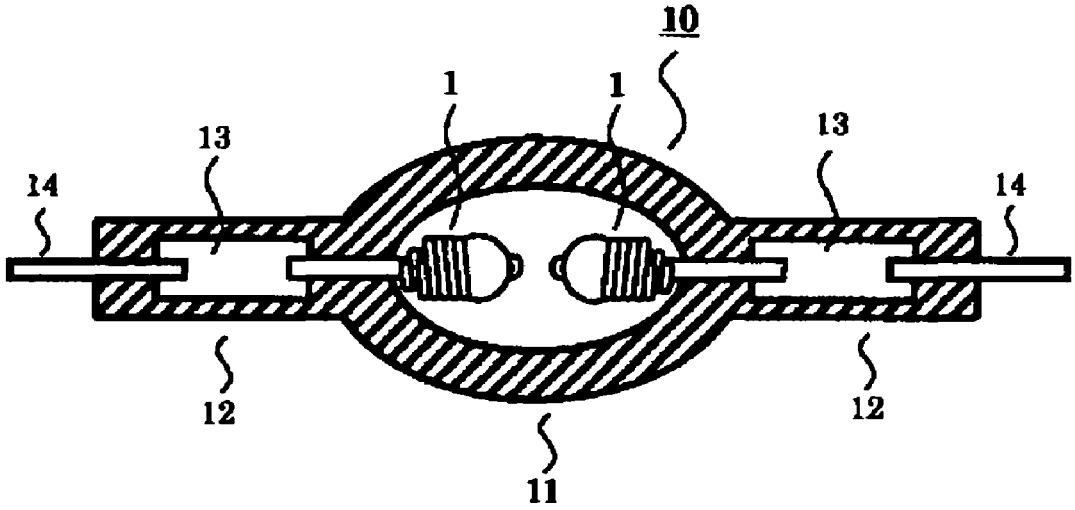
FIG. 1 is a schematic of the ultra-high pressure mercury lamp of the invention.

FIG. 1 shows the overall arrangement of the short arc ultra-high pressure mercury lamp as claimed in the invention (hereinafter also called only a "discharge lamp"). In the figure, a discharge lamp 10 has an essentially spherical light emitting part 11 which is formed from a silica glass discharge vessel. In this light emitting part 11, there is a pair of opposed electrodes 1. From opposite ends of the light emitting part 11, there extend hermetically sealed portions 12 in which a conductive metal foil 13 (normally made of molybdenum) is hermetically sealed, for example, by a shrink seal. Each of the electrodes 1 is electrically connected to one end the metal foil 13 by welding. An outer lead 14, which projects out of the sealed portions 12, is welded to the other end of the respective metal foil 13.

The light emitting part 11 is filled with mercury, a rare gas and a halogen gas. The mercury is used to obtain the required wavelength of visible radiation, for example, to obtain radiant light with wavelengths from 360 nm to 780 nm, and is added in an amount of at least 0.15 mg/mm$^3$. With this added amount, which may differ depending on the temperature condition, at least 150 atm, therefore an extremely high vapor pressure, are achieved during operation. By adding a larger amount of mercury, a discharge lamp with a high mercury vapor pressure during operation of at least 200 atm or 300 atm or more can be produced. The higher the mercury vapor pressure, the more suitable the light source which can be implemented for a projector device.

As the rare gas, for example, roughly 13 kPa of argon gas is added, by which the ignitability is improved.

The halogens can be iodine, bromine, chlorine and the like in the form of a compound with mercury or other metals. The amount of halogen added is selected from the range from $10^{-6}$ μmol/mm$^3$ to $10^{-2}$ μmol/mm$^3$. The halogen is intended to prolong the service life using the halogen cycle. For an extremely small discharge lamp with a high internal pressure, such as in the discharge lamp of the invention, the main purpose of adding the halogen is to prevent devitrification of the discharge vessel.

The numerical values of the discharge lamp are shown by way of example below.

For example:

the maximum outside diameter of the light emitting part is 9.5 mm;

the distance between the electrodes is 1.5 mm;

the inside volume of the arc tube is 75 mm$^3$;

the rated voltage is 80 V; and the rated wattage is 150 W.

The lamp is operated using an alternating current.

Such a discharge lamp is installed in a projector device which should be as small as possible. On the one hand, since the overall dimensions of the device are extremely small, and on the other hand, since there is a demand for high light intensity, the thermal influence in the arc tube portion is extremely strict. The value of the wall load of the lamp is 0.8 W/mm$^2$ to 2.0 W/mm$^2$, specifically 1.5 W/mm$^2$.

That the lamp has such a high mercury vapor pressure and such a high value of the wall load leads to the fact that it can offer radiant light with good color rendering if it is installed in a projector device or a presentation apparatus, such as an overhead projector or the like.

Figure 2:
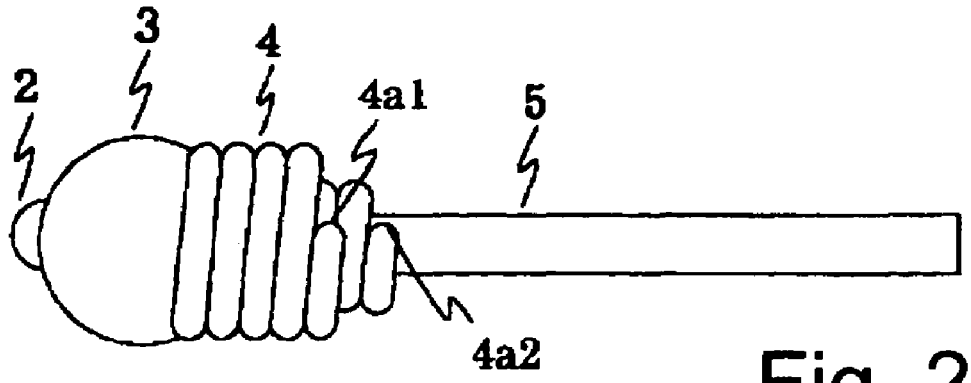
FIGS. 2(*a*) to 2(*c*) each schematically show the arrangement of one electrode of an ultra-high pressure mercury lamp in accordance with the invention.
Figure 2:
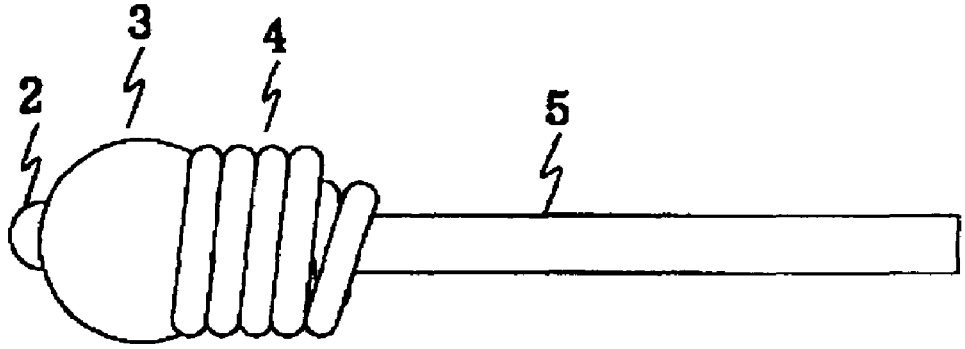
Figure 2:
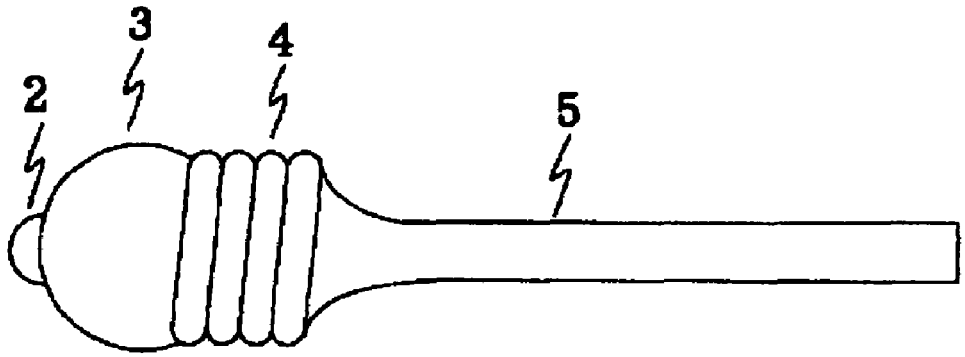

FIGS. 2(*a*), 2(*b*) and 2(*c*) each schematically show enlarged views of an embodiment of the electrode 1 of the invention. In FIGS. 2(*a*), 2(*b*) and 2(*c*), the electrode 1 has a projection 2, a part with a larger diameter 3, a coil 4 and the electrode rod 5.

The projection 2 is formed by the tip of the electrode rod 5 and has a value which is equal to the diameter of the electrode rod 5 or which as a result of melting is slightly larger or smaller than the diameter of the electrode rod 5. This means that the projection 2 is formed and does not grow by the operation of the discharge lamp, but it is formed by the tip of the electrode rod 5.

The part with the greater diameter 3, for example, is formed by winding, for example, filamentary tungsten in the manner of a coil and melting it, proceeding from this state. The melted part with a greater diameter therefore becomes rather lumpy (solid), by which the thermal capacity can be increased. Since especially the discharge lamp of the invention has extremely strict thermal conditions within the emission part, the part with a greater diameter 3 is required.

The coil part 4 is formed by the part of the coil which is left by the front part having been melted proceeding from the state in which, likewise, the filamentary tungsten is wound in the manner of a coil and by the part with a greater diameter 3 having been formed in this way. The coil part is conversely not melted. The coil part 4 when starting operation acts as the start position by the concave-convex (asperity) effect. It moreover has the function of a heat radiator by the concave-convex (asperity) effect of the surface after operation. Since the coil is thin, it is easily heated, by which it also has the function of facilitating the transition from the glow discharge into an arc discharge.

FIG. 2(*a*) shows an arrangement in which by melting the faces (cut-off ends) of the back ends 4*a* (4*a*1, 4*a*2) of the coil part 4 there is no angular area such as a burr or an edge. The arc discharge which has formed at the start of operation such that the coil part acts as the start point is therefore not continued after starting operation, but quickly passes to the projection 2.

The expression "arrangement without an acute angle" is defined as a curved surface treatment of the coil end. The expression "curved surface treatment" is defined as formation of a curved surface without a burr and without an edge. This curved surface treatment can be performed, for example, by irradiation with laser light or electron beams or by scraping with a file or the like.

In the arrangement as shown in FIG. 2(*a*) in which the coil is wound around the electrode rod 5 twice, it is necessary to carry out curved surface treatment such that neither on the end 4*a*2 of the internally wound coil nor on the end 4*a*1 of the externally wound coil will there be an acute angle. The reason for the double turn is to increase the thermal capacity.

FIG. 2(*b*) shows an arrangement in which the coil part which has been wound around the electrode rod 5 is wound from the electrode tip in the direction to the base point, afterwards turned over and wound again in the direction to the tip. This means that the end of the coil is melted to become one part with the part with a greater diameter 3. The end on the side of the base point has an arrangement without cut-off coil ends. Even for this arrangement of the coil part, the end on the base point side of the coil has an arrangement without an angular area, such as a burr or an edge.

The advantage of this arrangement is that, on the end on the side of the base point of the coil part 4, special treatment, such as irradiation with laser light or the like need not be performed, and that therefore, the work of production is greatly simplified.

In FIG. 2(*c*), the coil part 4 is melted not only at the front, but also on the back end to become one part with the electrode rod 5. On the side of the base point of the coil part, therefore not only is there no angular area, but even the end in itself is not present. The advantage of this arrangement is that an angular area, such as a burr or an edge can be avoided with certainty.

Figure 3:
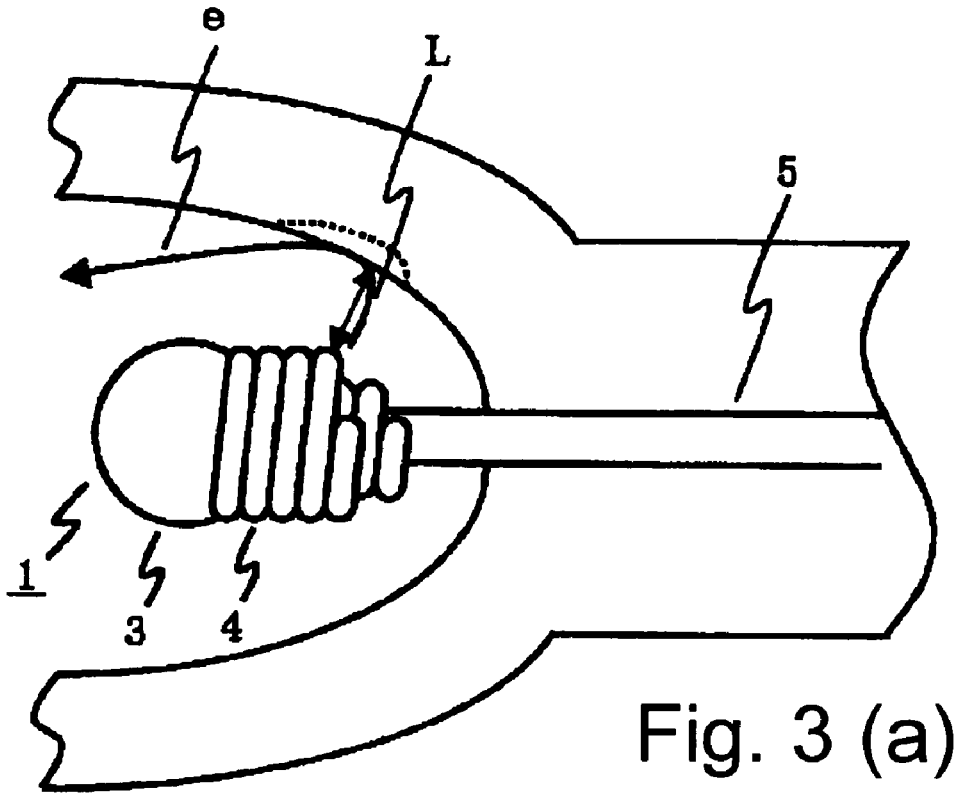
FIGS. 3(*a*) and 3(*b*) each schematically show the arrangement of one electrode of an ultra-high pressure mercury lamp of the invention.
Figure 3:
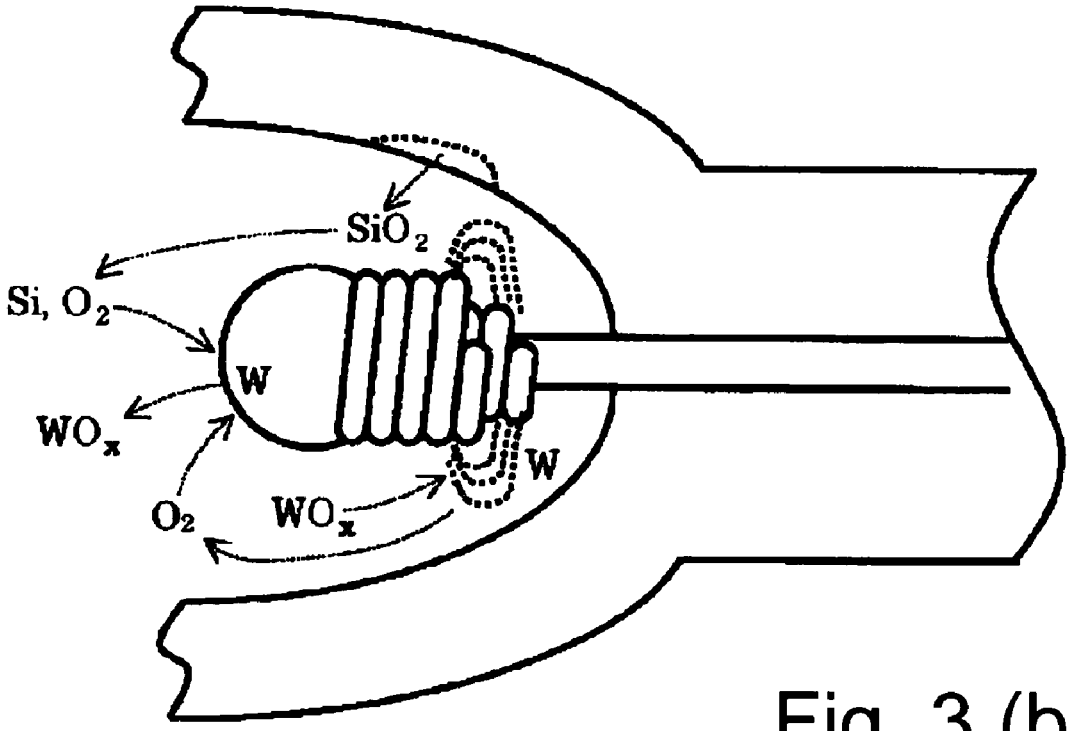
Figure 4:
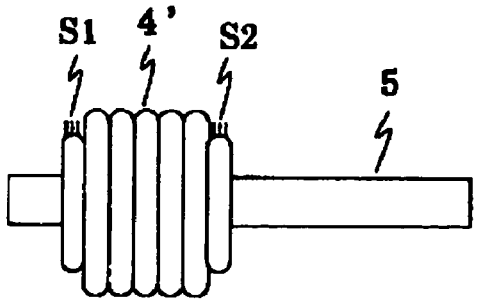
FIGS. 4(*a*) to 4(*d*) each depict a step in the process for producing the electrode of an ultra-high pressure mercury lamp of the invention.
Figure 4:
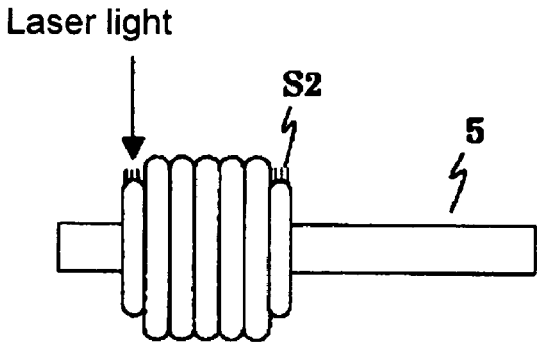
Figure 4:
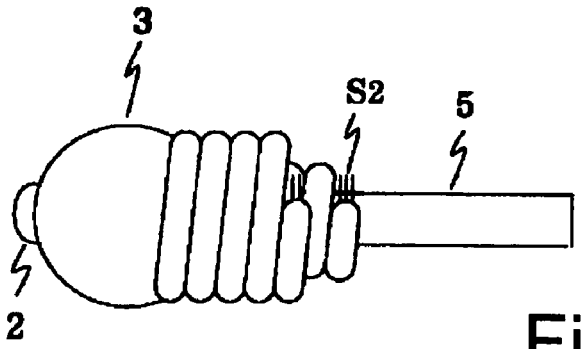
Figure 4:
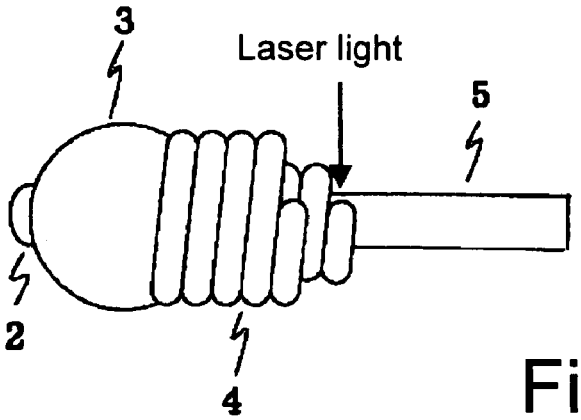

FIGS. 4(*a*) to 4(*d*) each schematically show one example of the process for producing the electrode 1. Using FIGS. 4(*a*) to 4(*d*), the process for producing the electrode arrangement as shown in FIG. 3(*a*) is described.

FIG. 4(*a*) shows the state before completion of the electrode. A tungsten electrode rod 5 is wound with a filamentary coil 4' which, for example, is made of tungsten and with which the electrode rod 5 is wound for example in two layers. On the end of the coil 4' there are angular areas (cut-off ends) such as a burr, an edge and the like, S1, S2.

The numerical values are shown by way of example below.

The length of the electrode rod 5 is in the range from 5.0 mm to 10.0 mm and is, for example, 7.0 mm; and the diameter of the electrode rod 5 is in the range from 0.2 mm to 0.6 mm and is, for example, 0.4 mm.

Furthermore, the position of the coil 4' is in the range from 0.4 mm to 0.6 mm from the tip of the electrode rod 5. The coil 4' is wound proceeding from a position which is, for example, 0.5 mm away from the tip of the electrode rod 5. Furthermore, the position of the coil 4' is in the range from 1.5 mm to 3.0 mm in the axial direction. The coil 4' is, for example, wound in a length of 1.75 mm.

The wire diameter of the coil 4' is in the range from 0.1 mm to 0.3 mm and is, for example, 0.25 mm. This wire diameter and the number of layers of the coil 4' can be suitably adjusted according to the specification of the discharge lamp and according to the light beam diameter of the laser light which is described below.

FIG. 4(*b*) shows the state in which the tip area of the coil 4' is irradiated with laser light. The laser light is radiant light, for example, from a YAG laser or the like, with which the end of the coil 4' is irradiated which is closest to the tip of the electrode rod 5. Afterwards, if necessary, the irradiation position is shifted towards the back end and irradiation is performed.

By reliable irradiation of a given position of the coil 4' with laser light, the coil 4' with which the electrode rod 5 is wound can be melted according to the design. In this way, the melt part with a greater diameter 3 can be formed, and moreover, the angular area S1 on the coil tip can also be removed.

FIG. 4(*c*) shows the state in which the part with the greater diameter 3 is formed by the above described laser light irradiation. In the part with a greater diameter 3 the surface is melted and smooth.

The numerical values are shown, by way of example, below.

The diameter of the projection is 0.15 mm to 0.6 mm and is, for example, 0.3 mm;

The length in the axial direction of the projection is 0.1 mm to 0.4 mm and is, for example, 0.25 mm;

The diameter of the part with the greater diameter is 1.0 mm to 2.0 mm and is, for example, 1.4 mm; and The length in the axial direction of the part with the greater diameter is 0.7 mm to 2.0 mm and is, for example, 1.0 mm.

The part with the greater diameter 3 can be formed by melting a coil. However, the coil part 4 is formed by the back end of the coil being left without melting. On the back end of the coil part 4 an angular area S2 is left.

In FIG. 4(*d*) the angular area S2 which is present on the back end of the coil part 4 is irradiated with laser light. The goal of laser irradiation in this process is to remove an angular area, such as a burr or the like, while the main goal of laser irradiation as shown in FIG. 4(*b*) is to form the electrode, such as the projection 2, the part with the greater diameter 3 and the like by melting the coil. In laser irradiation in this process, therefore, in contrast to the laser irradiation as shown in FIG. 4(*b*), the light intensity and the light beam diameter are changed.

It is advantageous that this irradiation with laser light as shown in FIGS. 4(*b*) and 4(*d*) is carried out in an atmosphere of argon gas or the like in order to prevent oxidation of the electrodes.

The numerical values are shown, by way of example, below with respect to the irradiation with laser light in the process as shown in FIG. 4(*b*).

The light beam diameter is 0.2 mm to 0.7 mm and is, for example, 0.6 mm; and the duration of irradiation is 0.2 sec to 1.0 sec, and is, for example, 0.35 sec.

In the process as shown in FIG. 4(*d*), the numerical values are generally smaller than these. However, in the case of a large angular area and in similar cases the numerical values are not limited to them.

Laser irradiation can be carried out without interruption. However, pulsed irradiation can also be carried out. In this case, the term "pulsed irradiation" is defined as irradiation in which irradiation with a short duration (millisecond range) and a pause are repeated. This irradiation is normally more effective than uninterrupted irradiation.

Instead of laser light irradiation, electron beams can also be used for irradiation. Since in an electron beam as well as in laser light, the diameter of the beam can also be made small, electron beams are suited for melting extremely small burrs and edges as in the invention.

With respect to the electron beams, for example, the electron beam devices disclosed in Japanese patent disclosure document 2001-59900 and Japanese patent disclosure document 2001-174596 are especially suited due to their small shape.

As was described above, the discharge lamp of the invention is treated such that there is no angular area on the end on the base point side of the coil. Therefore, the arc discharge which arises at the start of operation can be quickly shifted to the electrode tip. Accordingly, vaporization of $SiO_2$ on the inside of the discharge vessel as a result of base point discharge, vaporization of tungsten oxide from the electrode tip and its accumulation can be prevented or reduced. Consequently, deformation of the electrodes by accumulation of tungsten on the end at the base point side of the coil can be suppressed.

Here, in the discharge lamp according to the invention, it can be assumed first that the shortest distance (distance L in FIG. 3(*a*)) between the coil part and the inside of the discharge vessel is small. Because the shortest distance L is small, the base point discharge causes collision and contact of the arc with the inside of the discharge vessel. Specifically, the shortest distance L is at most 2.0 mm, and disadvantages occur especially clearly at a shortest distance L that is less than or equal to 1.5 mm or that is no greater than 1.0 mm.

Secondly, in the discharge lamp of the invention, a short arc ultra-high pressure mercury lamp is assumed in which the distance between the electrodes is at most equal to 2 mm and in which the light emitting part is filled with at least 0.15 $mg/mm^3$ of mercury, rare gas and halogen in the range from $1\times10^{-6}$ $\mu mole/mm^3$ to $1\times10^{-2}$ $\mu mole/mm^3$.

The reason for this is that, in a discharge lamp with this arrangement, the $SiO_2$ which has been released from the inside of the discharge vessel is decomposed by the discharge plasma into Si and O, the Si dissolves in the tungsten (W) electrode material, by which a reduction of the melting point and wear of the electrodes are caused. Furthermore, the tungsten reacts with oxygen (O) in the discharge space, is transported to the coil base point, and is deposited there. Here, if the amount of oxygen (O) is suitable, it acts like the halogen cycle and suppresses transport of the tungsten (W) to the inside wall of the discharge vessel. However, if due to the arc discharge which has formed such that the coil part has acted as the start point, $SiO_2$ vaporizes on the inside of the discharge vessel, the tungsten oxide ($WO_x$) in the discharge space increases, by which excess tungsten oxide is transported up to the end on the base point side of the coil and by which tungsten is deposited.

Therefore, it may be that an arrangement in which the electrode is wound with a coil, is conventionally known among those discharge lamps which do not have the above described arrangement and which have completely different applications and the like. However, since in such a discharge lamp, originally, the phenomenon of accumulation of tungsten on the end on the base point side of the coil does not occur, that is, the problem to which the present invention is directed does not exist, it can be stated that this prior art has a completely different level than the invention.

The discharge lamp in accordance with the invention is characterized in that the electrode tip is provided with a projection. This projection stabilizes the arc discharge, and in the case of a short arc discharge lamp in which the light emitting part is filled with at least 0.15 $mg/mm^3$ mercury, rare gas and a halogen in the range from $1\times10^{-6}$ $\mu mole/mm^3$ to $1\times10^{-2}$ $\mu mole/mm^3$, by extending this projection in a self-regulating manner, regulation of the distance between the electrodes to an optimum value is enabled.

By forming the projection beforehand using the electrode rod, it can control beforehand the direction of extension in a self-regulating manner. However, it is also possible not to form the projection in the production of the discharge lamp, but to form it proceeding from a so-called zero state (that is, complete absence of a projection) in the course of lamp operation.

The numerical values of the discharge lamp are shown, by way of example, below.

The outside diameter of the light emitting part is in the range from 8 mm to 12 mm and is, for example, 10.0 mm;

the inside volume of the light emitting part is in the range from 50 $mm^3$ to 120 $mm^3$ and is, for example, 65 $mm^3$; and the distance between the electrodes is in the range from 0.7 mm to 2 mm and is, for example, 1.0 mm.

The discharge lamp is operated with a rated wattage of 200 W and a rectangular shaped alternating current of 150 Hz.

It is desirable for the electrode 1 to consist of tungsten with a purity or greater than or equal to 99.9999%. This is because in the case of emission of impurities which are contained in the electrodes, devitrification and blackening of the discharge vessel are caused in the discharge space.

Figure 5:
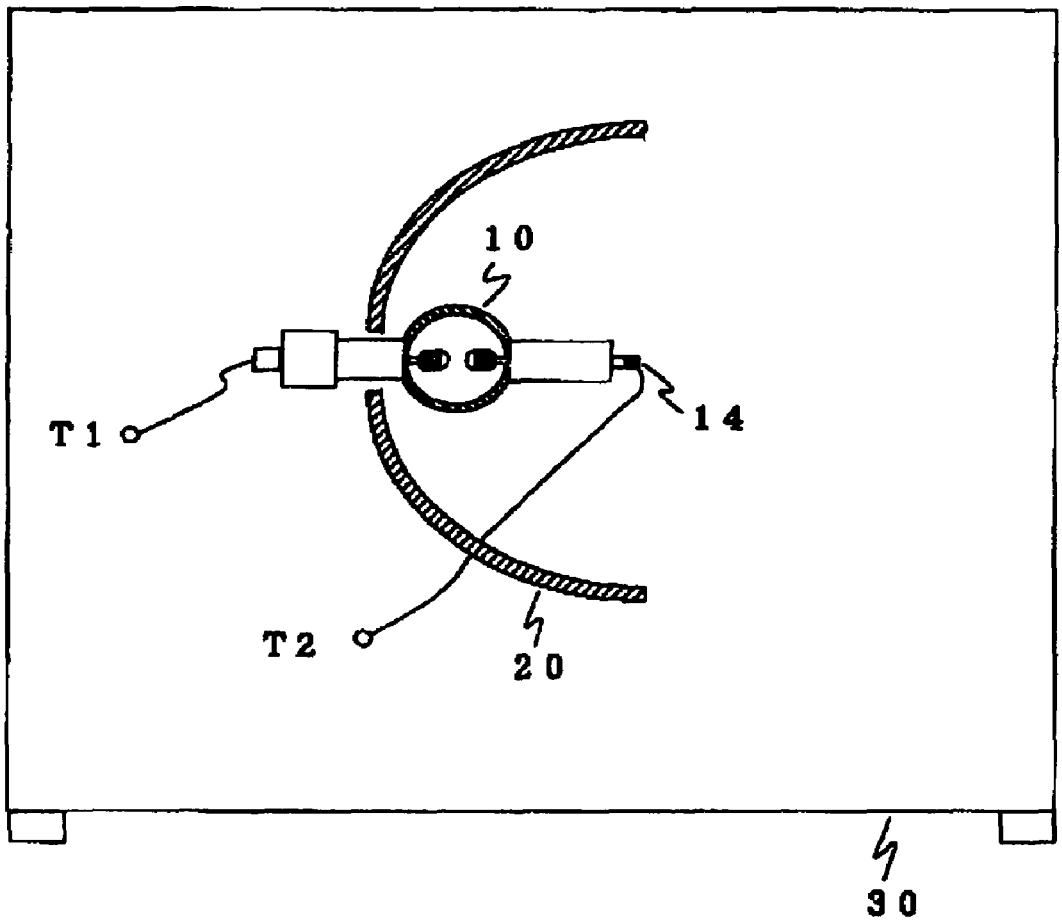
FIG. 5 is a schematic representation of a light source device using the ultra-high pressure mercury lamp in accordance with the invention.

FIG. 5 shows the state in which the discharge lamp 10 is mounted in a concave reflector 20 which surrounds this discharge lamp 10, and the combination of these two with one another (hereinafter the combination of the discharge lamp 10 with the concave reflector 20 is called a "light source device") are installed in a projector device 30. In the projector device 30, the optical parts which are complex in reality, electrical parts, and the like are tightly arranged. It is shown simplified in FIG. 5 to facilitate the description.

The discharge lamp 10 is held with one sealed portion inserted through a hole of the concave reflector 20. An operating device (not shown) is connected to the terminals T1 and T2 of the discharge lamp 10. For a concave reflector 20, an elliptical reflector or a parabolic reflector is used. The reflection surface is provided with a film which has been formed by evaporation and which reflects light with given wavelengths.

The focal position of the concave reflector 20 is aligned with the arc position of the discharge lamp 10. The light of the arc spot can emerge with high efficiency through the reflector. Furthermore, the concave reflector 20 can also be provided with transparent glass which closes the front opening.

It is desirable for the above described electrode arrangement to be used for the two electrodes of the discharge lamp. However, it can also be used only for one of the electrodes.

An ultra-high pressure mercury lamp of the AC operating type was described above. However, the invention can also be used for an ultra-high pressure mercury lamp of the DC operating type.

Action of the invention

As was described above, the feature of the electrode arrangement of the discharge lamp of the invention comprises processing the end on the base point side of the coil into a curved surface or in melt treatment of the end on the base point side of the coil so that neither a burr nor an edge are present. In this way, the progression of a so-called base point discharge can be prevented, and the tungsten can be prevented from accumulating on the end on the base point side of the coil part. Furthermore, the invention is characterized in that a projection is formed by the tip of the electrode rod.

What is claimed is:

1. Short arc ultra-high pressure mercury lamp, comprising:

a silica glass arc tube, a pair of opposed electrodes disposed in the arc tube with a distance of at most to 2 mm between them, and the arc tube being filled with at least 0.15 mg/mm$^3$ of mercury, a rare gas and an amount of a halogen in the range of from $1\times10^{-6}$ μmole/mm$^3$ to $1\times10^{-2}$ μmole/mm$^3$, wherein at least one of the electrodes includes a rod having a tip with an area toward the tip of the rod wound with a coil, wherein a front part of the coil oriented towards the tip of the rod is melted and a back end of the coil extending from the front melted part in a direction away from the electrode tip is unmelted and has a base point that is rounded and is free of sharp edges, wherein the shortest distance between the coil and an inside surface of the arc tube is at most 2.0 mm.

2. Short arc ultra-high pressure mercury lamp as claimed in claim 1, wherein said base point that is rounded and free of sharp edges has been subjected to rounding by curved surface treatment.

3. Short arc ultra-high pressure mercury lamp as claimed in claim 2, wherein said base point of the coil has been melted into a round shape.

4. Short arc ultra-high pressure mercury lamp as claimed in claim 1, wherein the coil has a double turn arrangement having an inner winding part running around the rod of the electrode from the electrode tip toward the base point, and an outer winding part that has been turned over and wound back from the base point toward the tip, and wherein an end of at least the outer winding part has been melted onto the melted part of the coil.

5. Short arc ultra-high pressure mercury lamp as claimed in claim 1, wherein the coil has an end that has been melted onto the rod of the electrode at the base point.

6. Short arc ultra-high pressure mercury lamp as claimed in claim 1, wherein the electrode is made of tungsten with a purity of at least 99.9999%.

7. Short arc ultra-high pressure mercury lamp as claimed in claim 1, wherein a projection is formed on the tip of the electrode.

8. Short arc ultra-high pressure mercury lamp as claimed in claim 7, wherein the projection is formed by the rod of the electrode.

9. Short arc ultra-high pressure mercury lamp as claimed in claim 1, wherein the diameter of the melted part of the coil increases in a direction away from the electrode tip and the back end of the coil has a diameter which is smaller than a maximum diameter of the melted part of the coil.

* * * * *